US005540091A

United States Patent [19]

Nakagawa

[11] Patent Number: 5,540,091

[45] Date of Patent: Jul. 30, 1996

[54] SELF-DIAGNOSIS APPARATUS FOR EXHAUST GAS RECIRCULATING SYSTEM

[75] Inventor: Akihiro Nakagawa, Himeji, Japan

[73] Assignee: Mitsubishi Denki Kabushiki Kaisha, Tokyo, Japan

[21] Appl. No.: 311,857

[22] Filed: Sep. 26, 1994

[30] Foreign Application Priority Data

Sep. 29, 1993 [JP] Japan ..... 5-243278

[51] Int. Cl.[6] ..... F02M 23/06

[52] U.S. Cl. ..... 73/117.3; 123/571

[58] Field of Search ..... 73/116, 117.2, 73/117.3, 118.2; 123/571

[56] References Cited

U.S. PATENT DOCUMENTS

| | | | |
|---|---|---|---|
| 4,164,207 | 8/1979 | Okitsu et al. | 123/571 |
| 4,281,631 | 8/1981 | Yamaguchi | 123/571 |
| 4,287,866 | 9/1981 | Ikuta et al. | 123/568 |
| 4,380,988 | 4/1983 | Otsuka et al. | 123/571 |
| 4,429,676 | 2/1984 | Gotoh et al. | 123/571 |
| 4,453,379 | 6/1984 | Kawamura et al. | 123/571 |
| 4,454,854 | 6/1984 | Gotoh et al. | 123/571 |
| 4,467,775 | 8/1984 | Buck et al. | 123/571 |
| 4,478,199 | 10/1984 | Narasaka et al. | 123/571 |
| 4,549,516 | 10/1985 | Koumura | 123/478 |
| 4,549,518 | 10/1985 | Koumura | 123/478 |
| 4,614,175 | 9/1986 | Asayama | 123/571 |
| 4,718,388 | 1/1988 | Kiuchi | 123/478 |
| 4,898,143 | 2/1990 | Fujimoto et al. | 123/571 |
| 4,947,820 | 8/1990 | Kushi | 123/571 |
| 4,974,572 | 12/1990 | Aramaki | 123/571 |
| 5,113,835 | 5/1992 | Seki et al. | 123/571 |
| 5,172,550 | 12/1992 | Takeshima | 123/571 |
| 5,251,599 | 10/1993 | Ohuchi et al. | 123/571 |
| 5,368,005 | 11/1994 | Kako | 73/117.3 |

FOREIGN PATENT DOCUMENTS

29937(A) 1/1990 Japan .

*Primary Examiner*—Hezron E. Williams
*Assistant Examiner*—Eric S. McCall
*Attorney, Agent, or Firm*—Sughrue, Mion, Zinn, Macpeak & Seas

[57] ABSTRACT

A self-diagnosis apparatus diagnoses an exhaust gas recirculating system of an internal combustion engine based on an amount of change in an intake pressure in a intake pipe which is caused by opening of an exhaust gas recirculation control valve which is disposed in a exhaust gas recirculating passage communicating between the intake pipe and an exhaust pipe. The apparatus determines whether or not a difference in engine speeds and/or amounts of engine control as measured before and after the exhaust gas recirculation control valve is opened exceeds a predetermined value, and executes the diagnosis when the difference in the engine speeds is not greater than a predetermined value and/or when the difference in the engine control amounts is not greater than a predetermined value.

8 Claims, 7 Drawing Sheets

SELF-DIAGNOSIS APPARATUS FOR EXHAUST GAS RECIRCULATING SYSTEM

BACKGROUND OF THE INVENTION

1. Field of the Invention

The present invention relates to a self-diagnosis apparatus for an exhaust recirculating system of an internal combustion engine such as an automotive engine and more particularly, to a self-diagnosis apparatus capable of exactly diagnosing the state of the exhaust gas recirculating system through an appropriate discrimination of a change in the intake pressure which is caused by, for example, a change in the engine load or a shifting operation of a transmission.

2. Description of the Related Arts

FIG. 6 schematically shows the construction of a known self-diagnosis apparatus of the type described above, which is disclosed in, for example, Japanese Patent Laid-Open No. 2-9937. Referring to this Figure, an internal combustion engine 1 has a combustion chamber 3, and an intake passage 2 and an exhaust passage 4 which communicate with the combustion chamber 3. The intake passage 2 comprises a throttle body 5 and an intake pipe 6. A surge tank 7 for accommodating pulsation of an intake pressure in the intake passage is disposed between the throttle body 5 and the intake pipe 6. The intake passage 2 and the exhaust passage 4 are connected to each other through an exhaust gas recirculating passage 8. An exhaust gas recirculation control valve (EGR valve) 9, which operates based on a pressure differential between the atmospheric pressure and the intake pressure, is disposed in the exhaust gas recirculating passage 8. The exhaust gas recirculation control valve 9 has a function to open and close the exhaust gas recirculating passage 8 in accordance with the state of operation of the engine 1 so as to introduce part of the exhaust gases from the exhaust passage 4 into the intake passage 2. Thus, the exhaust gas recirculation control valve 9 forms a critical portion of the exhaust gas recirculating system. The intake system of the engine 1 has a throttle valve 10 which is disposed in the throttle body 5 at a location upstream of the surge tank 7. An exhaust gas recirculation control port 11 opens to the intake passage 2 at a position upstream of the surge tank 7. The control port 11 communicates with a vacuum chamber defined in the exhaust gas recirculation control valve 9 through a vacuum passage 12. The vacuum passage 12 is provided with a vacuum switching valve which controls the operation of the exhaust gas recirculation control valve 9 in accordance with the level of a load on the engine 1. A pressure sensor 14 is selectively connected to one of the ambient air and a portion of the internal space in the intake passage 2 downstream of the surge tank 7, through a change-over valve 15, which switches a pressure detection region, for sensing an internal pressure in the intake passage 2. A microcomputer 16 receives signals from various sensors and performs various kinds of control such as the control of a fuel injection rate. To this end, the microcomputer 16 has a central processing unit 17, a memory 18, and input/output interfaces 19, 20. A throttle opening sensor 21 is disposed upstream of the surge tank 7 for sensing an opening of the throttle valve 10. A water-temperature sensor 22 measures the temperature of cooling water circulated through the engine 1. The engine 1 is provided with a distributer 23 which controls the timing of ignition. The distributer 23 has a crank angle sensor 24 which detects the angle of rotation of the crankshaft of the engine 1. The engine has a plurality of cylinders-each defining therein the aforesaid combustion chamber 3. Each cylinder is provided with a fuel injector 25 which injects fuel into a corresponding combustion chamber 3.

The operation of the above-mentioned known self-diagnosis apparatus for the exhaust gas recirculating system shown in FIG. 6 will be described with reference to FIG. 7, which shows a flow chart illustrative of the operation of the self-diagnosis apparatus. Step S1 determines whether or not the engine 1 is being decelerated. More specifically, the microcomputer 16 determines that the engine 1 is being decelerated, when the throttle valve 10 is in the fully closed position while the engine speed is higher than a prescribed speed which has been set in a light-load region, on condition that the temperature of the cooling water is higher than a predetermined temperature which has been set in a low-temperature region. The microcomputer 16 then operates to temporarily stop the supply of fuel from the fuel injector 25. When the microcomputer 16 has determined in Step S1 that the engine 1 is not being decelerated, the process proceeds to a main routine, whereas, if not, the process proceeds to Step S2. In Step S2, electrical power is supplied to the input terminals of the vacuum switching valve 13 to close it. The process then proceeds to Step S3 in which a determination is conducted as to whether the temperature of the cooling water exceeds a set temperature, e.g., 80° C., based on the signal from the water temperature sensor 22. If the set temperature is not exceeded, the process proceeds to the main routine, whereas, if the set temperature is exceeded, the process goes to Step S4. In Step S4, a determination is conducted as to whether the engine speed NE is within a predetermined range between NE1 and NE2, based on the engine speed signal coming from the crank angle sensor 24. If the engine speed NE does not fall within the-above-mentioned predetermined range, the process skips to the main routine, whereas, when the engine speed NE is found to fall within the above-mentioned range, Step S5 is executed.

In Step S5, the intake pressure PM immediately before the vacuum switching valve 13 is switched from close to open state is set in the memory 18 at an address PM1. The process then proceeds to Step S6. In Step S6, the now closed vacuum switching valve 13 is opened so as to enable introduction of vacuum into the vacuum chamber in the exhaust gas recirculation control valve 9. The process then proceeds to Step S7 in which the intake pressure PM immediately after the opening of the vacuum switching valve 13 is stored in the memory 18 at an address PM2. Step S8 is then executed to determine whether a pressure differential between the intake pressure PM1 measured immediately before the vacuum switching valve 13 is opened and the intake pressure PM2 as measured immediately after the opening of the valve 13 is greater than a set value P1 which is, for example, 60 mmHg. If the pressure differential is smaller than the set value P1, the process proceeds to Step S9 which determines that a failure has taken place in the exhaust gas recirculating system including the exhaust gas recirculation control valve 9, and sets the fact of occurrence of the failure in a predetermined address of the memory 18. The process then proceeds to the main routine. When the pressure differential is greater than a set value P1, the microcomputer 16 determines that there is no failure in the exhaust gas recirculating system, and the process is advanced to the main routine.

In the known self-diagnosis apparatus for the exhaust gas recirculating system as described, an exhaust gas recirculation control valve, which is disposed in the exhaust gas recirculation passage inter connecting the intake and exhaust passages, is caused to temporarily open and close during deceleration of the engine, and occurrence of any failure in the exhaust gas recirculating system is determined based on whether or not the amount of change in the intake pressure caused by a change in the operating state of the exhaust gas recirculation control valve falls within a predetermined range. This known self-diagnosis apparatus, however, suffers from the following problem when used with an engine having such a speed control function that controls the engine speed through varying the flow rate of intake air against a change in the level of loads such as an air conditioner, a power steering gear and the like. In such a case, the variation in the intake flow rate also causes a change in the intake pressure, so that the self-diagnosis apparatus cannot discriminate the change in the intake pressure caused by the operation of the exhaust gas recirculation control valve from changes in the intake pressure resulting from the engine speed control. Thus, the self-diagnosis apparatus may erroneously take any change in the intake pressure caused by the engine speed control as being a sign of a failure which is taking place in the exhaust gas recirculating system detected through the operation of the exhaust gas recirculation control valve. This results in failing to exactly diagnosing the state of the exhaust gas recirculating system.

The intake pressure is also apt to change due to a change in the engine speed caused by, for example, a shifting operation of a transmission associated with the engine. Such a change in the intake pressure may also cause erroneous diagnosis of the exhaust gas recirculating system.

SUMMARY OF THE INVENTION

Under these circumstances, it is a primary object of the present invention to provide a self-diagnosis apparatus for an exhaust gas recirculating system of an internal combustion engine which can correctly diagnose the exhaust gas recirculating system through exact detection of a change in the intake pressure caused by an opening or closing operation of the exhaust gas recirculation control valve.

According to one aspect of the present invention, there is provided a self-diagnosis apparatus for an exhaust gas recirculating system of an internal combustion engine in which exhaust gases is recirculated from an exhaust pipe to an intake pipe through an exhaust gas recirculation passage equipped with an exhaust gas recirculation control means, the apparatus comprising: first means for detecting a change in an intake pressure in the intake pipe and for generating a corresponding output signal; second means for detecting a difference between rotational speeds of the engine before and after the exhaust gas recirculation control means opens the exhaust gas recirculation passage; and third means for checking a failure of the exhaust gas recirculating system based on the amount of change in the intake pressure detected by the first means only when the difference between the engine rotational speeds detected by the second means is not greater than a predetermined value.

According to another aspect of the present invention, there is provided a self-diagnosis apparatus for diagnosing an exhaust gas recirculating system of an internal combustion engine which includes intake air flow-rate detecting means for detecting a flow rate of intake; air supplied to the engine through an intake pipe, intake pressure detecting means provided in the intake pipe for detecting a pressure in the intake pipe, exhaust gas recirculation control means disposed in an exhaust gas recirculating passage communicating between the intake pipe and an exhaust pipe of the engine for opening and closing the exhaust gas recirculating passage, engine speed detecting means for detecting a rotational speed of the engine, control means for controlling the exhaust gas recirculation control means in accordance with the outputs from the engine control amount converting means and the engine speed detecting means, the self-diagnosis apparatus comprises: first means for detecting a change in the intake pressure in the intake pipe and for generating a corresponding output signal; second means for detecting a difference between rotational speeds of the engine before and after the exhaust gas recirculation control means opens the exhaust gas recirculation passage; and third means for checking a failure of the exhaust gas recirculating system based on the amount of change in the intake pressure detected by the first means only when the difference between the engine rotational speeds detected by the second means is not greater than a predetermined value.

According to a further aspect of the present invention, there is provided a self-diagnosis apparatus for diagnosing an exhaust gas recirculating system of an internal combustion engine which includes intake air flow-rate detecting means for detecting a flow rate of intake air supplied to the engine through an intake pipe, intake pressure detecting means provided in the intake pipe for detecting a pressure in the intake pipe, engine control amount converting means for converting the intake air flow rate detected by the intake air flow-rate detecting means into a corresponding amount of control to be effected on the engine, exhaust gas recirculation control means disposed in an exhaust gas recirculating passage communicating between the intake pipe and an exhaust pipe of the engine for opening and closing the exhaust gas recirculating passage, engine speed detecting means for detecting a rotational speed of the engine, control means for controlling the exhaust gas recirculation control means in accordance with the outputs from the engine control amount converting means and the engine speed detecting means, the self-diagnosis apparatus comprising: first means for detecting a change in the intake pressure in the intake pipe and for generating a corresponding output signal; second means for detecting a difference between amounts of control of the engine before and after the exhaust gas recirculation control means opens the exhaust gas recirculation passage; and third means for checking a failure of the exhaust gas recirculating system based on the amount of change in the intake pressure detected by the first means only when the difference between the engine control amounts detected by the second means is not greater than a predetermined value.

According to a still further aspect of the present invention, there is provided a self-diagnosis apparatus for diagnosing an exhaust gas recirculating system of an internal combustion engine which includes intake air flow-rate detecting means for detecting a flow rate of intake air supplied to the engine through an intake pipe, intake pressure detecting means provided in the intake pipe for detecting a pressure in the intake pipe, engine control amount converting means for converting the intake air flow rate detected by the intake air flow-rate detecting means into a corresponding amount of control to be effected on the engine, exhaust gas recirculation control means disposed in an exhaust gas recirculating passage communicating between the intake pipe and an exhaust pipe of the engine for opening and closing the exhaust gas recirculating passage, engine speed detecting means for detecting a rotational speed of the engine, control means for controlling the exhaust gas recirculation control means in accordance with the outputs from the engine control amount converting means and the engine speed detecting means, the self-diagnosis apparatus comprising:

first means for detecting a change in the intake pressure in the intake pipe and for generating a corresponding output signal; second means for detecting a difference between rotational speeds of the engine before and after the exhaust gas recirculation control means opens the exhaust gas recirculation passage; third means for detecting a difference between amounts of control of the engine before and after the exhaust gas recirculation control means opens the exhaust gas recirculation passage; and fourth means for checking a failure of the exhaust gas recirculating system based on the amount of change in the intake pressure detected by the first means when the difference between the engine rotational speeds detected by the second means is not greater than a predetermined value and when the difference between the engine control amounts detected by the second means is not greater than a predetermined value.

In a preferred form of the invention, the diagnosing means determined that a failure has occurred in the exhaust gas recirculating system, when the amount of change in the intake pressure is not greater than a predetermined value.

Thus, according to the present invention, the diagnosis of the state of the exhaust gas recirculating system including the exhaust gas recirculation control means is performed based on the amount of change in the intake pressure in the engine, when the amount of change in the engine speed and/or the amount of control by the engine speed control system is not greater than a predetermined value. It is therefore possible to exclude any erroneous diagnosis which might otherwise be caused by a change in the intake pressure attributable to a change in the engine speed and/or a change in the amount of control performed by the engine speed control system.

The above and other objects, features and advantages of the present invention will become clear from the following description of preferred embodiments when read in conjunction with the accompanying drawings.

DESCRIPTION OF THE PREFERRED EMBODIMENTS

Figure 1:
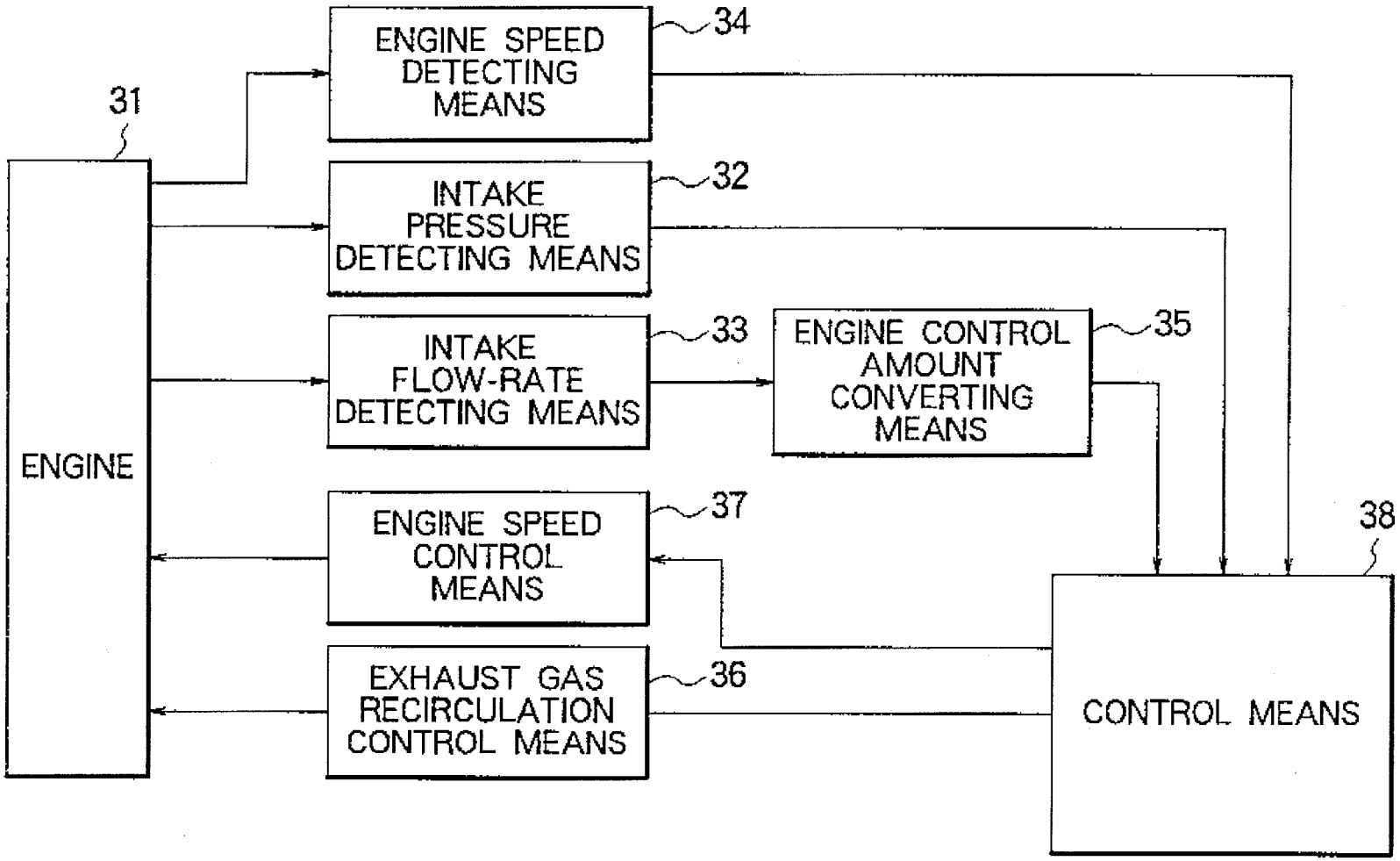
FIG. 1 is a block diagram showing the construction of an embodiment of the present invention.

Embodiment 1:

FIG. 1 is a block diagram showing the construction of a first embodiment of a self-diagnosis apparatus for an exhaust gas recirculating system constructed in accordance with the present invention. Referring to this Figure, the self-diagnosis apparatus has an engine speed detecting means 34 provided on an engine 31, an intake pressure detecting means 32 for measuring the pressure in the intake pipe, an intake air flow-rate detecting means 33, an engine speed control means 37, and an exhaust gas recirculating control means 36. An engine control amount converting means 35 is connected to the intake air flow-rate detecting means 33. The intake pressure detecting means 32, the engine speed detecting means 34 and the engine control amount converting means 35 are connected at their outputs to a control means 38 to which are connected inputs of the exhaust gas recirculation control means 36 and the engine speed control means 37. The engine 31 is equipped with an intake pipe (denoted at 40 in FIG. 2) through which the engine 31 sucks in ambient air. The pressure of the intake air inside the intake pipe 40 is detected by the intake pressure detecting means 32. The flow rate of the intake air supplied to the engine 31 through the intake pipe 40 is measured by the intake air flow-rate detecting means 33. The engine speed detecting means 34 measures the rotational speed of the engine, i.e., the number of revolutions of an engine crankshaft per unit time. The engine control amount converting means,35 converts the flow rate of intake air measured by the intake air flow-rate detecting means 33 into a corresponding amount of control of the engine 31. The exhaust gas recirculation control means 36 is provided in an exhaust gas recirculating passage (denoted at 42 in FIG. 2) which provides communication between an exhaust pipe (denoted at 41 in FIG. 2) and the intake pipe 40 of the engine 31, so as to open and close the exhaust gas recirculating passage 42 in a controlled manner. The engine speed control means 37 is provided in the intake pipe 40 so as to control the flow rate of the air supplied to the engine 31 in accordance with a deviation of the measured engine speed from a desired or given engine speed so as to control the actual engine speed in conformity with the given speed. The control means 38 controls the exhaust gas recirculation control means 36 and the engine speed control means 37, upon receipt of the outputs from the engine control amount converting means 35 and the engine speed detecting means 34.

Figure 2:
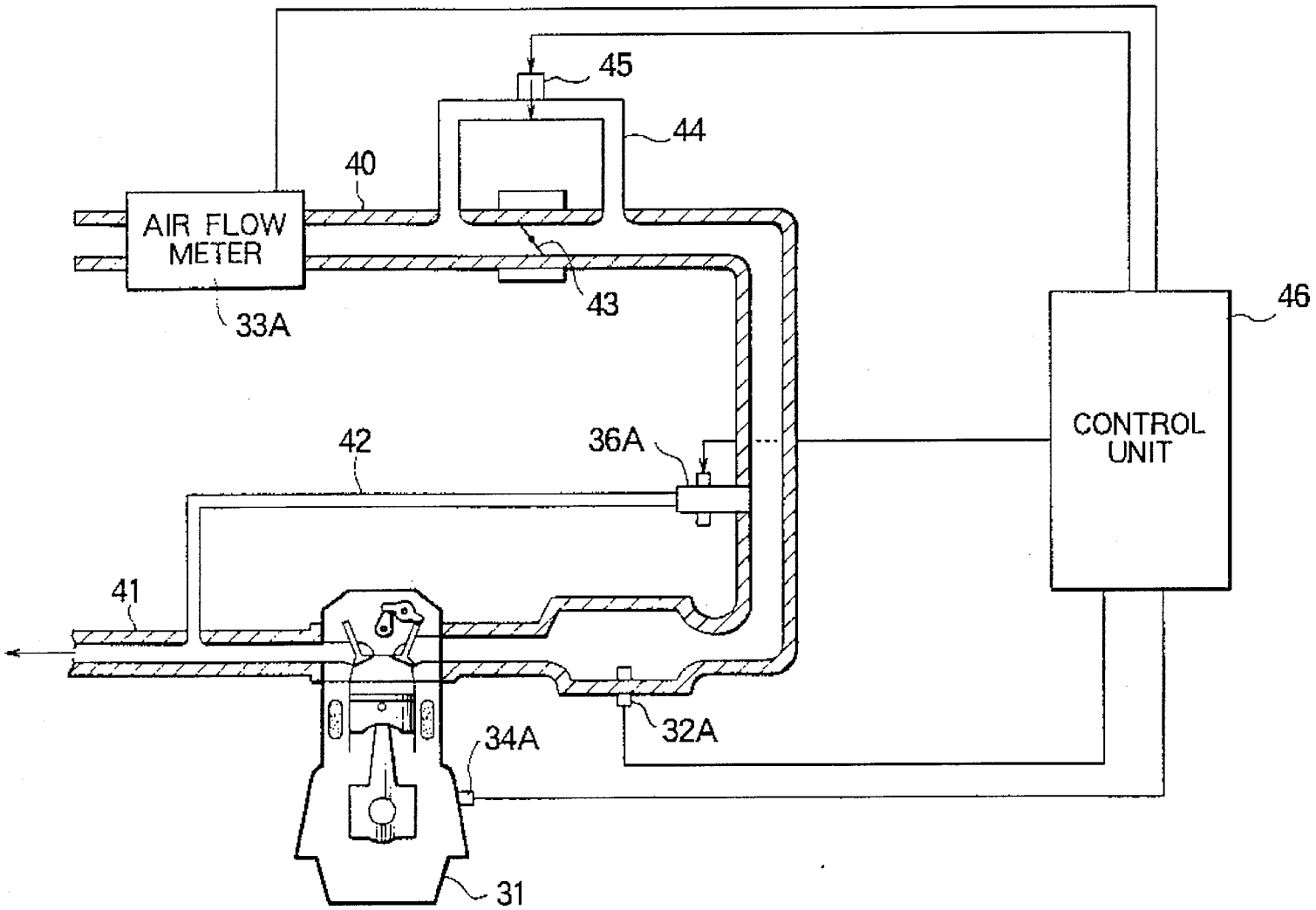
FIG. 2 is a schematic illustration of the embodiment shown in FIG. 1.

FIG. 2 illustrates a practical arrangement of the embodiment shown in FIG. 1. Referring to this Figure, an intake pressure sensor 32A is mounted on the intake pipe 40 so as to serve as the intake pressure detecting means 32. An air flowmeter 33A associated with the intake pipe 40 serves as the intake flow-rate detecting means 33 for detecting the flow rate of the intake air supplied to the engine 31. A crank angle sensor 34A attached to the crankshaft of the engine 31 functions as the engine speed detecting means 34 for measuring the speed of the engine 31. An exhaust gas recirculation control valve 36A is disposed in an exhaust gas recirculating passage 42 which interconnects the intake pipe 40 and the exhaust pipe 41 of the engine 31, so as to serve as the exhaust gas recirculation control means 36 which opens and closes the exhaust gas recirculating passage 42. A throttle butterfly valve 43, which is operatively connected to an accelerator pedal (not shown), is disposed in the intake pipe 40 at a position downstream of the air flowmeter 33A, so as to open and close in response to operation of the accelerator pedal. A by-pass passage 44 interconnects the portions of the intake pipe 40 upstream and downstream of the throttle butterfly valve 43. An idle speed control (ISC) valve 45 is disposed in the by-pass passage 44 so as to control the flow rate of the air through the by-pass passage 44. The throttle butterfly valve 43, the by-pass passage 44 and the idle speed control valve 45 cooperate to provide the engine speed control means 37 of the self-diagnosis apparatus of this embodiment. The engine speed control means 37, however, may simply be constructed so as to actuate the throttle butterfly valve 43 to control the intake air flow rate. The engine control amount converting means 35 and the control means 38 are realized by a control unit 46 which has a microcomputer, an input interface, an A/D converter and so forth. The control unit 46 controls the exhaust gas recirculation control valve 36A and the idle speed control valve 45 in accordance with the engine speed detected by the crank angle sensor 34A and the intake air flow-rate or intake air volumetric efficiency measured by the air flowmeter 33A. The control unit 46 also opens and closes the exhaust gas recirculation control valve 36A under predetermined conditions, and performs diagnosis of the exhaust gas recirculating system to find any failure therein, based on the intake air flow rate or intake air volumetric efficiency detected by the air flowmeter 33A and the intake pressure detected by the intake pressure sensor 32A. Thus, the control unit 46 provides diagnosis means in the self-diagnosis apparatus of this embodiment.

Figure 3:
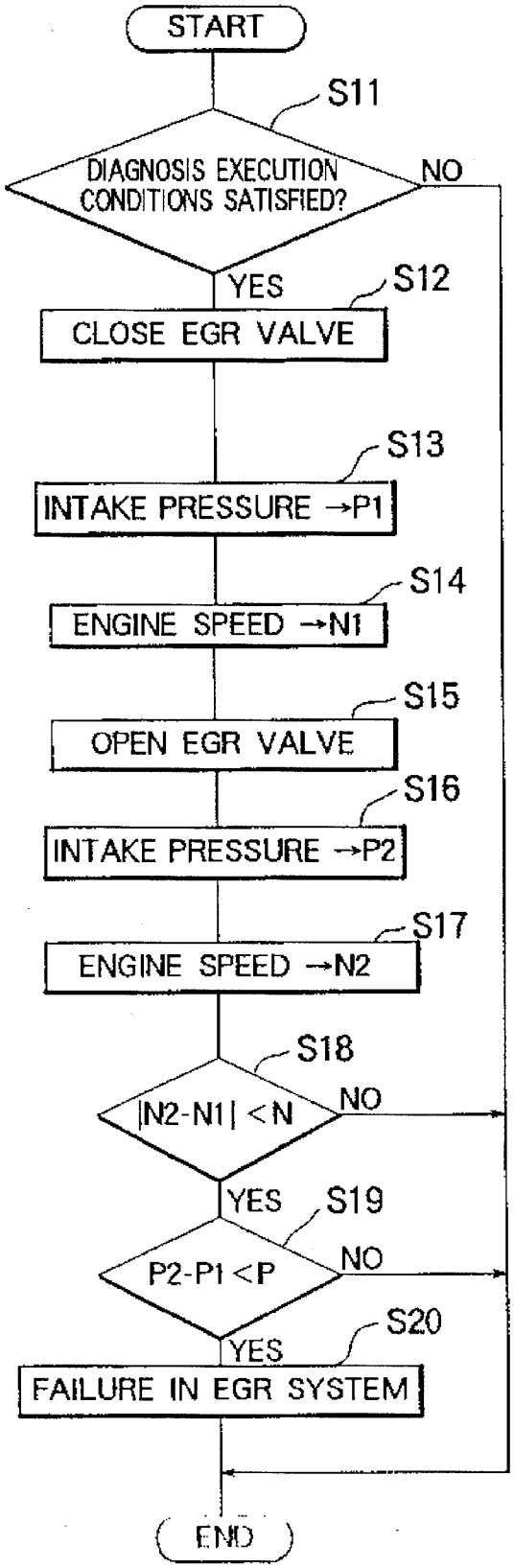
FIG. 3 is a flow chart illustrative of the operation of the embodiment of FIG. 1.

The operation of this embodiment will be described with specific reference to FIG. 3 which is a flow chart illustrative of the operation of this embodiment.

In Step S11, the control unit 46 determines whether or not the conditions for execution of failure diagnosis have been satisfied, e.g., whether or not the engine 31 is being decelerated, whether or not the engine speed falls within a predetermined speed range,and so forth, based on the output from the crank angle sensor 34A. If the conditions for execution of the diagnosis are not met, the diagnosis routine terminates without executing the diagnosis. Conversely, if the conditions have been satisfied, the process proceeds to Step S12 which controls the exhaust gas recirculation control valve 36A and, after closing this valve, the process advances to Step S13. In Step S13, the control unit 46 operates to perform A/D conversion of the intake pressure detected by the intake pressure sensor 32A under such a condition that the exhaust gas recirculation control valve 36 is closed, and stores the converted digital value P1 of the intake pressure in a RAM. In Step S14, the engine speed N1 at which the intake pressure is detected is stored in the RAM in Step S15, the control unit 46 controls the exhaust gas recirculation control valve 36A so as to open this valve.

Similarly, in Step S16, the control unit 46 performs A/D conversion of the intake pressure detected by the intake pressure sensor 32A under a condition that the exhaust gas recirculation control valve 36 has been opened, and stores the digital value P2 of the detected pressure in the RAM. In Step S17, the engine speed N2 at the time of detection of the intake pressure is stored in the RAM. The process then proceeds to Step S18 in which the control unit 46 performs a determination as to whether or not the absolute value |N2–N1| of a difference between the engine speed N1 as measured before the exhaust gas recirculation control valve 36A is opened and the engine speed N2 as measured after the valve 36 is opened exceeds a predetermined value N. If the absolute value is greater than the predetermined value N, the control unit 46 decides that the diagnosis cannot be correctly carried out, and stops the diagnosis routine. Conversely, if the absolute value is smaller than the predetermined value N, the control unit 46 decides that the diagnosis can be correctly carried out, and advances the process to Step S19. In Step S19, the control unit 46 determines whether or not a difference (P2–P1) between the intake pressure values P1 and P2 as measured by the intake pressure sensor 32A before and after the exhaust gas recirculation control valve 36A is opened is smaller than a predetermined value P. If the difference (P2–P1) exceeds the predetermined value P, the control unit 46 determines that there is no failure in the exhaust gas recirculating system, and terminates the diagnosis routine. Conversely, when the difference (P2–P1 ) is smaller than the predetermined value P, the process proceeds to Step S20 in which it is determined that a failure has taken place in the exhaust gas recirculation system, thus completing the self-diagnosis routine.

Thus, in the first embodiment of the present invention, occurrence of any failure in the exhaust gas recirculation system is correctly detected by virtue of the comparing step in which the engine speeds before and after the opening of the exhaust gas recirculation control valve 36A are compared with each other to exclude any change in the intake pressure which is caused by a change in the engine speed.

Figure 4:
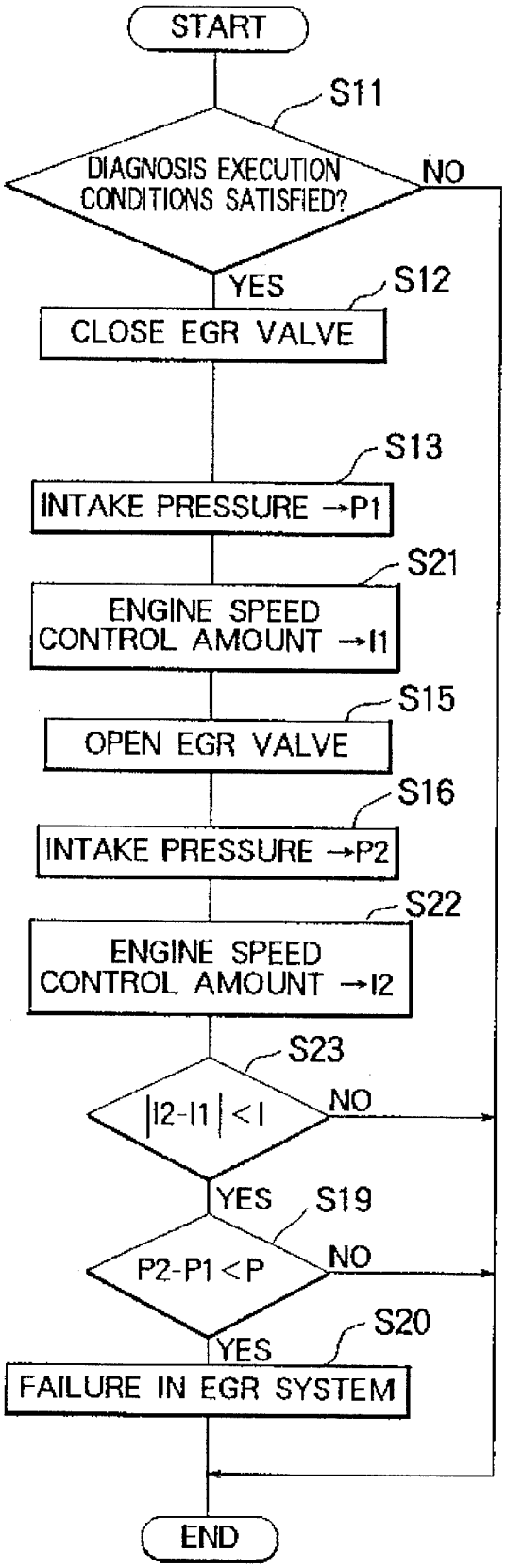
FIG. 4 is a flow chart illustrative of the operation of another embodiment of the present invention.

Embodiment 2:

A description will now be given of a second embodiment of the present invention. FIG. 4 is a flow chart illustrative of the operation of the second embodiment. In this Figure, Steps having the same numbers as those appearing in FIG. 3 have the same functions as those of the routine shown in FIG. 3. The practical construction of the diagnosis apparatus is substantially the same as that of the first embodiment shown in FIG. 2.

In Step S11, the control unit 46 determines whether or not the conditions for execution of failure diagnosis have been satisfied, e.g., whether or not the engine 31 is being decelerated, whether or not the engine speed falls within a predetermined speed range, and so forth, based on the detection output from the crank angle sensor 34A. If the conditions for execution of the diagnosis are not met, the diagnosis routine terminates without executing the diagnosis. Conversely, if the conditions have been satisfied, the process proceeds to Step S12 which controls the exhaust gas recirculation control valve 36A and, after closing this valve, the process advances to Step S13. In Step S13, the control unit 46 operates to perform A/D conversion of the intake pressure detected by the intake pressure sensor 32A under such a condition that the exhaust gas recirculation control valve 36A is closed, and stores the converted digital value P1 of the intake pressure in a RAM. In Step S21, the amount I1 of control of the engine speed at the time when the intake pressure is detected is stored in the RAM. The amount of control of the engine speed in this case is the amount of control of the by-pass flow rate performed by the idle speed control (ISC) valve 45. In Step S15, the control unit 46 controls the exhaust gas recirculation control valve 36A so as to open this valve.

Similarly, in Step S16, the control unit 46 performs A/D conversion of the intake pressure detected by the intake pressure sensor 32A under a condition that the exhaust gas recirculation control valve 36 has been opened, and stores the digital value P2 of the detected pressure in the RAM in Step S22, the amount 12 of the engine speed control at the time of detection of the intake pressure is stored in the RAM. The process then proceeds to Step S23 in which the control unit 46 performs a determination as to whether or not the absolute value |I2–I1| of a difference between the engine speed control amount I1 as detected before the exhaust gas recirculation control valve 36A is opened and the engine speed control amount I2 as detected after the valve 36A is opened exceeds a predetermined value I. If the absolute value is greater than the predetermined value I, the control unit 46 decides that the diagnosis cannot be correctly carried out, and stops the diagnosis routine. Conversely, if the absolute value is smaller than the predetermined value I, the control unit 46 decides that the diagnosis can be correctly carried out, and advances the process to Step S19. In Step S19, the control unit 46 determines whether or not a difference (P2–P1 ) between the intake pressure values P1 and P2 as measured by the intake pressure sensor 32A before and after the exhaust gas recirculation control valve 36A is opened is smaller than a predetermined value P. If the difference (P2–P1) exceeds the predetermined value P, the control unit 46 determines that there is no failure in the exhaust gas recirculating system, and terminates the diagnosis routine. Conversely, when the difference (P2–P1) is smaller than the predetermined value P, the process proceeds to Step S20 in which it is determined that a failure has taken place in the exhaust gas recirculation system, thus completing the self-diagnosis routine.

Thus, in the second embodiment of the present invention, occurrence of any failure in the exhaust gas recirculation system is correctly detected by virtue of the comparing step in which the engine speed control amounts before and after the opening of the exhaust gas recirculation control valve 36A are compared with each other to exclude any change in the intake pressure which is caused by a change in the amount of engine speed control.

Figure 5:
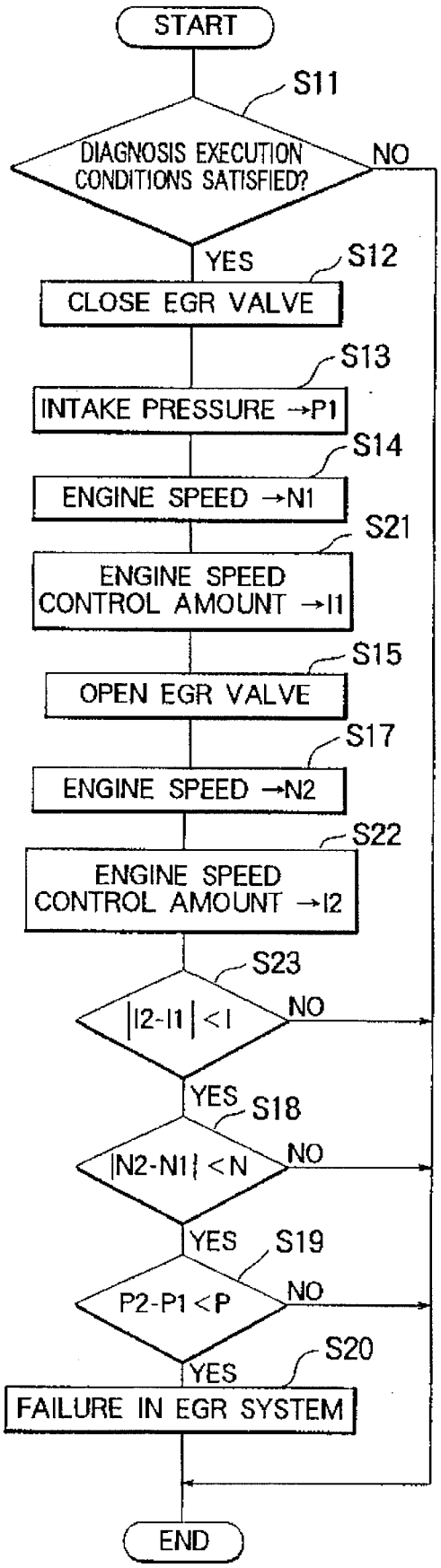
FIG. 5 is a flow chart illustrative of the operation of a further embodiment of the present invention.
Figure 6:
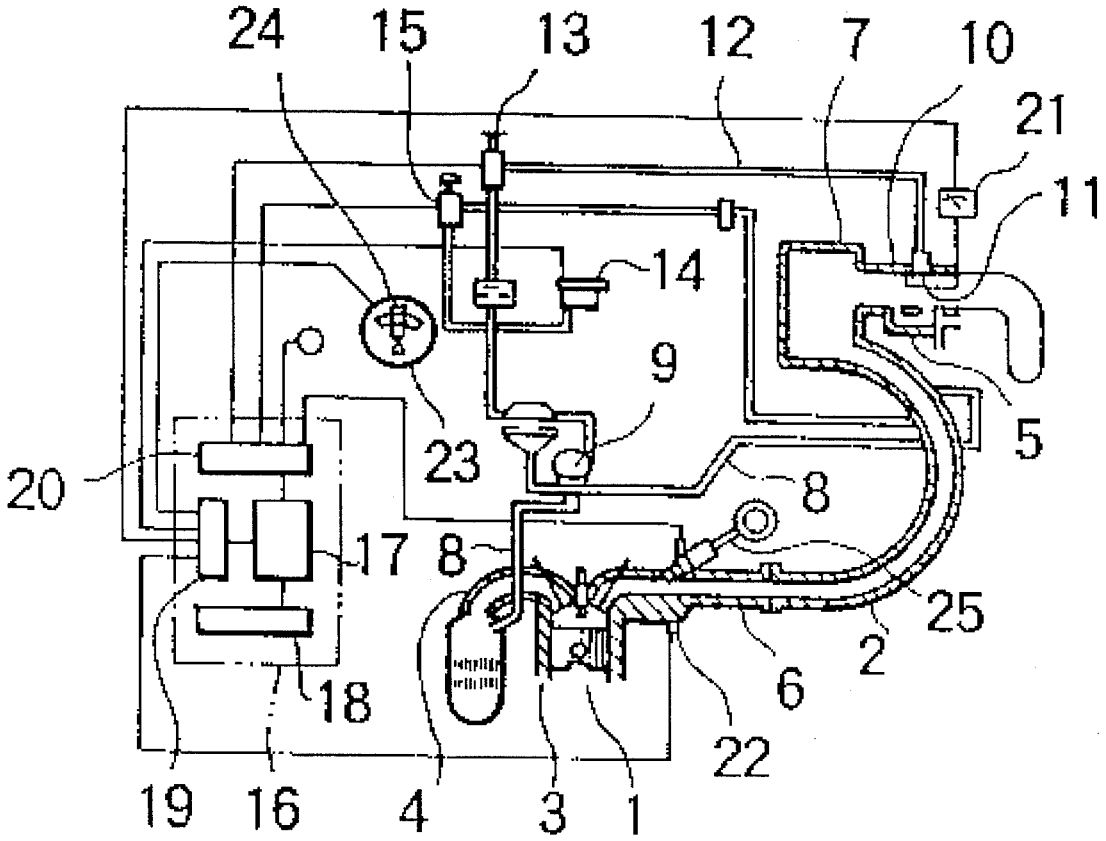
FIG. 6 PRIOR ART
FIG. 6 is a schematic illustration of a known self-diagnosis apparatus for exhaust gas recirculation system.
Figure 7:
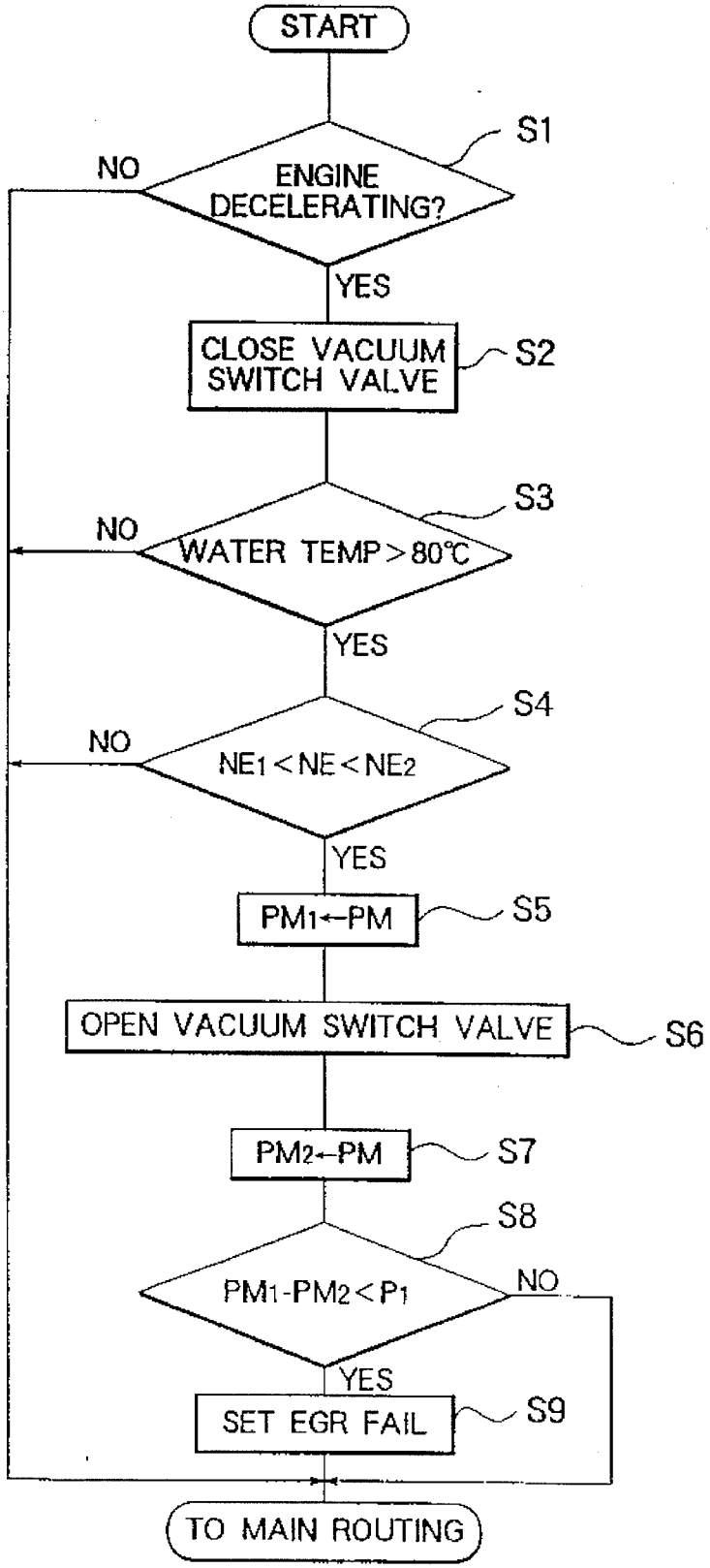
FIG. 7 PRIOR ART
FIG. 7 is a flow chart illustrative of the operation of the known self-diagnosis apparatus shown in FIG. 6.

Embodiment 3:

A description will now be given of a third embodiment of the present invention. FIG. 5 is a flow chart illustrative of the operation of the third embodiment. In this Figure, Steps with the same numbers as those appearing in FIGS. 3 and 4 denote the same functions as those in the routines shown in FIGS. 3 and 4. This third embodiment is carried out using a practical construction which is similar to those used in the first and second embodiments.

The third embodiment is different from the preceding embodiments in that it employs both the comparing steps employed in the first and second embodiments to doubly check whether the conditions for execution of the diagnosis are met. Namely, in the third embodiment, Steps S14 and S17 are followed to store the engine speeds before and after the opening of the exhaust gas recirculation control valve 36A, and the difference between these engine speeds is compared with a predetermined value in Step S18.. In addition, Steps S21 and S22 are followed to store the amounts of engine speed control before and after the opening of the exhaust gas recirculation control valve 36A, and a difference between these engine speed control amounts is compared with a predetermined value in Step S23. Thus, the third embodiment offers a further improvement in the reliability of the diagnosis, as it adopts both the diagnosis routines of the first and second embodiments.

What is claimed is:

1. A self-diagnosis apparatus for an exhaust gas recirculating system of an internal combustion engine in which exhaust gases are recirculated from an exhaust pipe to an intake pipe through an exhaust gas recirculation passage equipped with an exhaust gas recirculation control means, said apparatus comprising:

first means for detecting a change in an intake pressure in said intake pipe and for generating a corresponding output signal;

second means for detecting a difference between rotational speeds of said engine before and after said exhaust gas recirculation control means opens said exhaust gas recirculation passage; and third means for checking a failure of said exhaust gas recirculating system based on an amount of change in the intake pressure detected by said first means only when the difference between said engine rotational speeds detected by said second means is not greater than a predetermined value.

2. An exhaust gas recirculating system of an internal combustion engine comprising:

intake air flow-rate detecting means for detecting a flow rate of intake air supplied to said engine through an intake pipe;

intake pressure detecting means provided in said intake pipe for detecting a pressure in said intake pipe;

exhaust gas recirculation control means disposed in an exhaust gas recirculating passage communicating between said intake pipe and an exhaust pipe of said engine for opening and closing said exhaust gas recirculating passage;

engine speed detecting means for detecting a rotational speed of said engine;

control means for controlling said exhaust gas recirculation control means in accordance with outputs from said engine control amount converting means and said engine speed detecting means;

a self-diagnosis apparatus for diagnosing said exhaust gas recirculating system, wherein said self diagnosis apparatus comprises:

first means for detecting a change in the intake pressure in said intake pipe and for generating a corresponding output signal;

second means for detecting a difference between rotational speeds of said engine before and after said exhaust gas recirculation control means opens said exhaust gas recirculation passage; and third means for checking a failure of said exhaust gas recirculating system based on an amount of change in the intake pressure detected by said first means only when the difference between said engine rotational speeds detected by said second means is not greater than a predetermined value.

3. A self-diagnosis apparatus according to claim 2, wherein said third means determines that a failure has occurred in said exhaust gas recirculating system when the amount of change in the intake pressure is not greater than a predetermined value.

4. An exhaust gas recirculating system of an internal combustion engine comprising;

intake air flow-rate detecting means for detecting a flow rate of intake air supplied to said engine through an intake pipe;

intake pressure detecting means provided in said intake pipe for detecting a pressure in said intake pipe;

engine control amount converting means for converting the intake air flow rate detected by said intake air flow-rate detecting means into a corresponding amount of control to be effected on said engine;

exhaust gas recirculation control means disposed in an exhaust gas recirculating passage communicating between said intake pipe and an exhaust pipe of said engine for opening and closing said exhaust gas recirculating passage;

engine speed detecting means for detecting a rotational speed of said engine;

control means for controlling said exhaust gas recirculation control means in accordance with outputs from said engine control amount converting means and said engine speed detecting means;

a self-diagnosis apparatus for diagnosing said exhaust gas recirculating system, wherein said self-diagnosis apparatus comprises:

first means for detecting a change in the intake pressure in said intake pipe and for generating a corresponding output signal;

second means for detecting a difference between amounts of control of said engine before and after said exhaust gas recirculation control means opens said exhaust gas recirculation passage; and third means for checking a failure of said exhaust gas recirculating system based on amount of change in the intake pressure detected by said first means only when the difference between said engine control amounts detected by said second means is not greater than a predetermined value.

5. A self-diagnosis apparatus according to claim 4, wherein said third means determines that a failure has occurred in said exhaust gas recirculating system when the amount of change in the intake pressure is not greater than predetermined value.

6. An exhaust gas recirculating system of an internal combustion engine comprising;

intake air flow-rate detecting means for detecting a flow rate of intake air supplied to said engine through an intake pipe;

intake pressure detecting means provided in said intake pipe for detecting a pressure in said intake pipe;

engine control amount converting means for converting the intake air flow rate detected by said intake air flow-rate detecting means into a corresponding amount of control to be effected on said engine;

exhaust gas recirculation control means disposed in an exhaust gas recirculating passage communicating between said intake pipe and an exhaust pipe of said engine for opening and closing said exhaust gas recirculating passage;

engine speed detecting means for detecting a rotational speed of said engine;

control means for controlling said exhaust gas recirculation control means in accordance with outputs from said engine control amount converting means and said engine speed detecting means;

a self-diagnosis apparatus for diagnosing said exhaust gas recirculating system, wherein said self-diagnosis apparatus comprises:

first means for detecting a change in the intake pressure in said intake pipe and for generating a corresponding output signal;

second means for detecting a difference between rotational speeds of said engine before and after said exhaust gas recirculation control means opens said exhaust gas recirculation passage;

third means for detecting a difference between amounts of control of said engine before and after said exhaust gas recirculation control means opens said exhaust gas recirculation passage; and fourth means for checking a failure of said exhaust gas recirculating system based on an amount of change in the intake pressure detected by said first means only when the difference between said engine rotational speeds detected by said second means is not greater than a predetermined value and only when the difference between said engine control amounts detected by said second means is not greater than a predetermined value.

7. A self-diagnosis apparatus according to claim 6, wherein said fourth means determines that a failure has occurred in said exhaust gas recirculating system when the amount of change in the intake pressure is not greater than a predetermined value.

8. A self-diagnosis apparatus as claimed in claim 1, wherein said self-diagnosis apparatus further comprises:

fourth means for detecting a difference between amounts of control of said engine before and after said exhaust gas recirculation control means opens said exhaust gas recirculation passage, wherein said third means checks for said failure of said exhaust gas recirculating system only when the difference between said engine rotational speeds detected by said second means is not greater than a predetermined value and only when the difference between amounts of control detected by said fourth means is not greater than a predetermined value.

* * * * *